US009202420B2

(12) United States Patent
Murayama

(10) Patent No.: US 9,202,420 B2
(45) Date of Patent: Dec. 1, 2015

(54) DRIVING METHOD OF ELECTROPHORETIC DISPLAY DEVICE, ELECTROPHORETIC DISPLAY DEVICE AND ELECTRONIC APPARATUS

(75) Inventor: Tetsuro Murayama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 544 days.

(21) Appl. No.: 13/306,236

(22) Filed: Nov. 29, 2011

(65) Prior Publication Data

US 2012/0139896 A1 Jun. 7, 2012

(30) Foreign Application Priority Data

Dec. 1, 2010 (JP) ..... 2010-268760

(51) Int. Cl.
*G09G 3/34* (2006.01)

(52) U.S. Cl.
CPC ..... *G09G 3/344* (2013.01); *G09G 2300/0857* (2013.01); *G09G 2320/041* (2013.01); *G09G 2320/066* (2013.01)

(58) Field of Classification Search
CPC ..... C07K 14/415; C12N 15/8261; C12N 15/827; C12N 15/8271; C12N 15/8273; G09G 2300/0857; G09G 2320/041; G09G 2320/066; G09G 3/344
USPC ..... 345/101, 107, 213–214, 589
See application file for complete search history.

(56) References Cited

U.S. PATENT DOCUMENTS

2007/0229443 A1* 10/2007 Sawada et al. ..... 345/101
2008/0024431 A1* 1/2008 Ishii ..... 345/107
2008/0238867 A1 10/2008 Maeda et al.
2009/0073111 A1 3/2009 Miyazaki
2009/0189850 A1* 7/2009 Murayama ..... G09G 3/344 345/107
2009/0237392 A1 9/2009 Kajino
2009/0322735 A1* 12/2009 Takei ..... 345/214
2010/0001946 A1* 1/2010 Murayama ..... G02F 1/167 345/107
2010/0073282 A1* 3/2010 Murayama ..... G09G 3/3446 345/107
2010/0118046 A1* 5/2010 Miyasaka et al. ..... 345/589
2010/0188395 A1* 7/2010 Uchida et al. ..... 345/214
2011/0304654 A1* 12/2011 Murayama ..... G09G 3/3446 345/690
2012/0139891 A1* 6/2012 Murayama ..... G09G 3/344 345/212
2012/0139896 A1* 6/2012 Murayama ..... G09G 3/344 345/214
2014/0071183 A1* 3/2014 Murayama ..... G09G 3/344 345/690

FOREIGN PATENT DOCUMENTS

JP 2004-085606 A 3/2004
JP 2009-069467 A 4/2009
JP 2009-258614 A 11/2009
JP 2010-044397 A 2/2010
JP 2010-223876 A 10/2010
JP 2011-099898 A 5/2011

* cited by examiner

*Primary Examiner* — Quan-Zhen Wang
*Assistant Examiner* — Tony Davis

(57) ABSTRACT

An image rewriting process includes a first pulse application process for using a driving pulse signal with the pulse width of a first electric potential being a first width; a driving stop process for stopping generation of an electric field between pixel electrodes and a common electrode, performed after the first pulse application process; and a second pulse application process for using the driving pulse signal with the pulse width of the first electric potential being a second width, performed after the driving stop process.

20 Claims, 11 Drawing Sheets

DRIVING METHOD OF ELECTROPHORETIC DISPLAY DEVICE, ELECTROPHORETIC DISPLAY DEVICE AND ELECTRONIC APPARATUS

CROSS-REFERENCE TO RELATED APPLICATION

This application claims priority to Japanese Patent Application No. 2010-268760 filed on Dec. 1, 2010. The entire disclosure of Japanese Patent Application No. 2010-268760 is hereby incorporated herein by reference.

BACKGROUND

1. Technical Field

The present invention relates to a driving method of an electrophoretic display device, an electrophoretic display device, and an electronic apparatus.

2. Related Art

In recent years, a display panel having a memory ability, which is capable of retaining an image even though power is cut off, has been developed and used for an electronic watch or the like. As the display panel having the memory ability, an EPD (electrophoretic display) device, a liquid crystal display device having a memory ability, or the like has been proposed.

In the electrophoretic display device, it is known that a display change occurs according to an environmental temperature. An electrophoretic display device disclosed in JP-A-2004-085606 changes the intensity of an electric field generated between a common electrode and a pixel electrode by controlling a driving voltage according to an environmental temperature. For example, in a case where the environmental temperature at which the electrophoretic display device is used is low (hereinafter, referred to as a low temperature), the driving voltage of a pulse signal applied to the electrodes is set to be high to strengthen the electric field, thereby preventing contrast from being lowered.

Here, the contrast has the same meaning as a contrast ratio. That is, in an electrophoretic display device which uses black and white as basic display colors, the contrast refers to the ratio of an arrival reflectance indicating white and an arrival reflectance indicating black. In the electrophoretic display device, even though the electric field is continuously applied between the common electrode and the pixel electrode, the reflectance is saturated. The arrival reflectance refers to the saturated reflectance. The arrival reflectance is changed according to an operation condition of the electrophoretic display device including the environmental temperature.

In this regard, it has been experimentally confirmed that even though electric power (driving voltage×driving time) of a pulse signal supplied to a common electrode and a pixel electrode is increased, in a case where partial driving is performed at a low temperature, contrast is lowered. That is, in a case where the partial driving for rewriting in only apart of a display section is performed at the low temperature, even though the driving voltage of the applied pulse signal becomes high or even though the driving time thereof becomes long, the contrast is lowered compared with the case of a temperature other than the low temperature. Thus, a display quality of the electrophoretic display device may deteriorate.

SUMMARY

An advantage of some aspects of the invention is that it provides a driving method of an electrophoretic display device and the like which are capable of performing a high contrast display even at a low temperature.

(1) An aspect of the invention is directed to a driving method of an electrophoretic display device including a display section in which an electrophoretic element including electrophoretic particles is disposed between a pair of substrates and a plurality of pixels is arranged, wherein a pixel electrode corresponding to the pixel is formed between one of the substrates and the electrophoretic element and a common electrode which faces the plurality of pixel electrodes is formed between the other one of the substrates and the electrophoretic element. The method includes: an image rewriting process of rewriting an image displayed on the display section by applying a voltage based on a driving pulse signal, in which a first electric potential and a second electric potential which is different from the first electric potential are repeated, to the common electrode, by applying the voltage based on the driving pulse signal to each of the plurality of pixel electrodes, and by moving the electrophoretic particles by an electric field generated between the common electrode and the pixel electrodes. The rewriting process includes: a first pulse application using the driving pulse signal with the pulse width of the first electric potential being a first width; a driving stop stopping the generation of the electric field between the common electrode and the pixel electrodes, performed after the first pulse application; and a second pulse application using the driving pulse signal with the pulse width of the first electric potential being a second width, performed after the driving stop.

According to this aspect of the invention, since the rewriting includes the driving stop stopping the generation of the electric field between the common electrode and the pixel electrodes between the first pulse application and the second pulse application, it is possible to prevent the electric field between both the electrodes from being weakened, thereby making it possible to performing a high contrast display even at the low temperature.

(2) In the driving method of the electrophoretic display device, the rewriting may include a temperature determination determining whether an environmental temperature is a predetermined threshold temperature or higher, and in a case where it is determined in the temperature determination that the environmental temperature is the predetermined threshold temperature or higher, only the first pulse application may be performed.

(3) In the driving method of the electrophoretic display device, in a case where it is determined in the temperature determination that the environmental temperature is the predetermined threshold temperature or higher, a driving time of the first pulse application may be shortened in the rewriting.

With this configuration, it is determined in the temperature determination whether the environmental temperature is the low temperature at which the contrast may be lowered, and only the first pulse application is performed in the case of the temperature other than the low temperature, and thus, the response at the time of image rewriting is quickened. Further, it is possible to perform a high contrast display regardless of the environmental temperature. Here, in the case of the temperature other than the low temperature, it is possible to reach the arrival reflectance in a short time compared with the case of the low temperature. Thus, in the case of the temperature other than the low temperature, the driving time of the pulse signal in the first pulse application may be shortened, and the response at the time of image rewriting may be quickened. Here, the threshold temperature is 10° C., for example.

(4) In the driving method of the electrophoretic display device, the first electric potential or the second electric potential may be applied to all of the common electrode and the pixel electrodes, in the driving stop.

(5) In the driving method of the electrophoretic display device, all of the common electrode and the pixel electrodes may be in a high impedance state, in the driving stop.

With this configuration, the driving stop stops the generation of the electric field between the pixel electrodes and the common electrode by the following method. Firstly, in the driving stop, a common fixed electric potential may be applied to all of the common electrode and the plurality of pixel electrodes. By applying the fixed electric potential, it is possible to reliably stop the generation of the electric field between the electrodes. Here, the fixed electric potential may be the second electric potential, but is preferably the first electric potential which is different from an electric potential of a reverse electric potential pulse (which will be described later). Further, all of the common electrode and the plurality of pixel electrodes may be in the high impedance state. At this time, it is possible to suppress power consumption by stopping the driving of the signal supplied to the electrodes.

(6) In the driving method of the electrophoretic display device, the second width which is longer than the first width may be used in the second pulse application.

With this configuration, by setting the second width to be longer than the first width, it is possible to sufficiently move the electrophoretic particles in the second pulse application, and as a result, to enhance the contrast.

(7) Another aspect of the invention is directed to an electrophoretic display device including: a display section in which an electrophoretic element including electrophoretic particles is disposed between a pair of substrates and a plurality of pixels is arranged; and a control section which controls the display section. The display section includes: a pixel electrode which is formed between one of the substrates and the electrophoretic element to correspond to the pixel; and a common electrode which is formed between the other one of the substrates and the electrophoretic element to face the plurality of pixel electrodes. The control section performs an image rewriting control for rewriting an image displayed on the display section by applying a voltage based on a driving pulse signal, in which a first electric potential and a second electric potential which is different from the first electric potential are repeated, to the common electrode, by applying the voltage based on the driving pulse signal to each of the plurality of pixel electrodes, and by moving the electrophoretic particles by an electric field generated between the common electrode and the pixel electrodes. In the image rewriting control, the control section performs: a first pulse application control for using the driving pulse signal with the pulse width of the first electric potential being a first width; a driving stop control for stopping the generation of the electric field between the common electrode and the pixel electrodes, performed after the first pulse application control; and a second pulse application control for using the driving pulse signal with the pulse width of the first electric potential being a second width, performed after the driving stop control.

According to this aspect of the invention, since the image rewriting control includes the driving stop control for stopping the generation of the electric field between the common electrode and the pixel electrodes between the first pulse application control and the second pulse application control, it is possible to prevent the electric field between both the electrodes from being weakened, thereby making it possible to performing a high contrast display even at the low temperature.

(8) In the electrophoretic display device, the control section may include a temperature determination circuit which determines whether an environmental temperature is a predetermined threshold temperature or higher, and in a case where it is determined by the temperature determination circuit that the environmental temperature is the predetermined threshold temperature or higher, only the first pulse application control may be performed in the image rewriting control.

With this configuration, it is determined in the temperature determining control whether the environmental temperature is the low temperature at which the contrast may be lowered, and only the first pulse application control is performed in the case of the temperature other than the low temperature, and thus, the response at the time of image rewriting is quickened. Further, it is possible to perform a high contrast display regardless of the environmental temperature.

(9) Still another aspect of the invention is directed to an electronic apparatus including the electrophoretic display device as described above.

According to this aspect of the invention, it is possible to provide an electronic apparatus which includes the electrophoretic display device which sequentially performs the first pulse application control, the driving stop control and the second pulse application control in the case of at least the low temperature and is thus capable of performing a high contrast display even at the low temperature, as the image rewriting control for the image rewriting.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
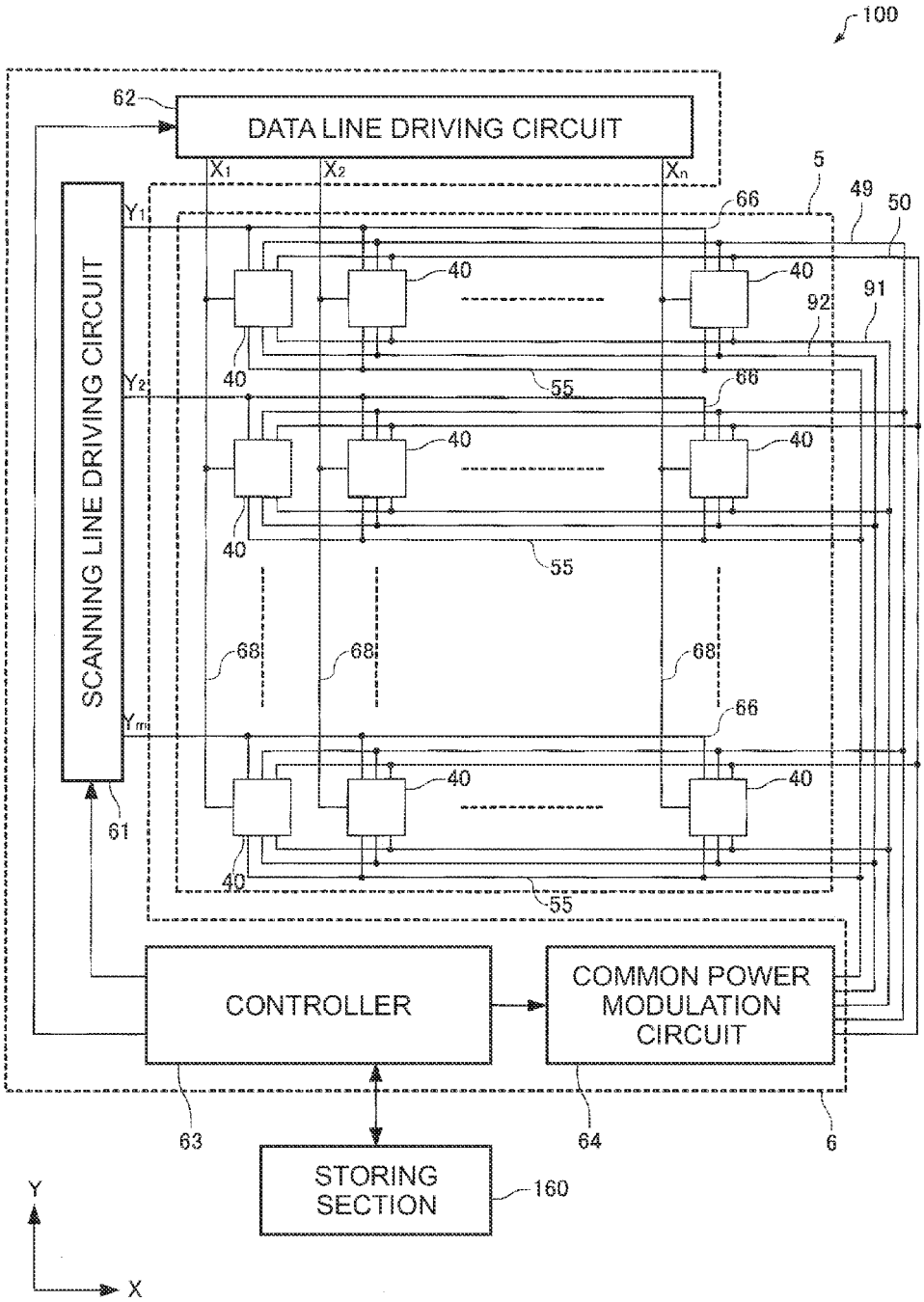
FIG. 1 is a block diagram illustrating an electrophoretic display device according to a first embodiment.

Hereinafter, embodiments of the invention will be described with reference to the accompanying drawings. With regard to a second embodiment and thereafter, the same reference numerals are given to the same configuration as in a first embodiment, and detailed descriptions thereof will be omitted.

1. First Embodiment

The first embodiment of the invention will be described with reference to FIG. 1 to FIG. 7B.

1.1. Electrophoretic Display Device 1.1.1. Configuration of Electrophoretic Display Device FIG. 1 is a block diagram illustrating an electrophoretic display device 100 of an active matrix drive type according to the present embodiment.

The electrophoretic display device 100 includes a control section 6, a storing section 160 and a display section 5. The control section 6 controls the display section 5, and includes a scanning line driving circuit 61, a data line driving circuit 62, a controller 63, and a common power modulation circuit 64. The scanning line driving circuit 61, the data line driving circuit 62, and the common power modulation circuit 64 are connected to the controller 63, respectively. The controller 63 generally controls these sections on the basis of image signals or the like read from the storing section 160 or sync signals supplied from the outside. The control section 6 may be configured to include the storing section 160. For example, the storing section 160 may be a memory which is built into the controller 63.

Here, the storing section 160 may be an SRAM, a DRAM or a different memory, and stores at least data (image signals) about images displayed on the display section 5. Further, information to be controlled by the controller 63 may be stored in the storing section 160.

A plurality of scanning lines 66 which extends from the scanning line driving circuit 61 and a plurality of data lines 68 which extends from the data line driving circuit 62 are formed in the display section 5, and a plurality of pixels 40 is formed to correspond to intersections thereof.

The scanning line driving circuit 61 is connected to respective pixels 40 by m scanning lines 66 ($Y_1, Y_2, \ldots, Y_m$). By sequentially selecting the scanning lines 66 from the first line to the m-th line under the control of the controller 63, the scanning line driving circuit 61 supplies a selection signal which regulates an on-timing of a driving TFT 41 (see FIG. 2) which is disposed in a pixel 40.

The data line driving circuit 62 is connected to the respective pixels 40 by n data lines 68 ($X_1, X_2, \ldots, X_n$). The data line driving circuit 62 supplies, to the pixel 40, an image signal which regulates image data of one bit corresponding to each of the pixels 40, under the control of the controller 63. In the present embodiment, if image data "0" is regulated, an image signal of a low level is supplied to the pixel 40, and if image data "1" is regulated, an image signal of a high level is supplied to the pixel 40.

A low electric potential power line 49 (Vss), a high electric potential power line 50 (Vdd), a common electrode wiring 55 (Vcom), a first pulse signal line 91 ($S_1$) and a second pulse signal line 92 ($S_2$), which extend from the common power modulation circuit 64, are disposed in the display section 5. The respective wirings are connected to the pixel 40. The common power modulation circuit 64 generates a variety of signals which are supplied to the respective wirings under the control of the controller 63, and also performs electric connection and disconnection of the respective wirings (high impedance, Hi-Z).

1.1.2. Circuit Configuration of Pixel Portion

Figure 2:
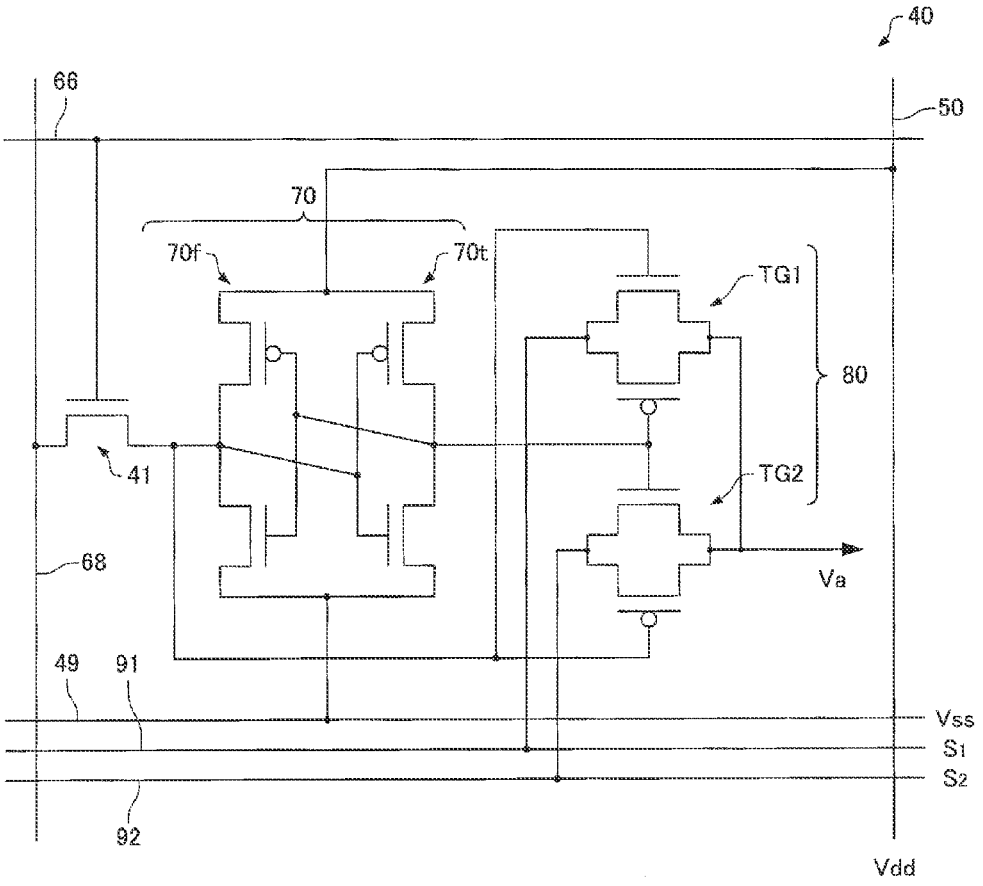
FIG. 2 is a diagram illustrating a configuration example of a pixel of the electrophoretic display device according to the first embodiment.

FIG. 2 is a diagram illustrating a circuit configuration of the pixel 40 in FIG. 1. The same reference numerals are given to the same wirings as in FIG. 1, and detailed descriptions thereof will be omitted. Further, description about the common electrode wirings 55 which are common in all pixels will be omitted.

The driving TFT (Thin Film Transistor) 41, a latch circuit 70, and a switch circuit 80 are disposed in the pixel 40. The pixel 40 has a configuration of an SRAM (Static Random Access Memory) type which holds an image signal as an electric potential by the latch circuit 70.

The driving TFT 41 is a pixel switching element including an N-MOS transistor. Agate terminal of the driving TFT 41 is connected to the scanning line 66, and a source terminal thereof is connected to the data line 68. Further, a drain terminal thereof is connected to a data input terminal of the latch circuit 70. The latch circuit 70 includes a transfer inverter 70*t* and a feedback inverter 70*f*. Power voltage is supplied to the inverters 70*t* and 70*f* from the low electric potential power line 49 (Vss) and the high electric potential power line 50 (Vdd).

The switch circuit 80 includes transmission gates TG1 and TG2, and outputs a signal to a pixel electrode 35 (see FIGS. 3B and 3C) according to the level of the pixel data stored in the latch circuit 70. Here, "Va" represents an electric potential (signal) supplied to the pixel electrode of one pixel 40.

If the image data "1" (image signal of the high level) is stored in the latch circuit 70 and the transmission gate TG1 is turned on, the switch circuit 80 supplies a signal $S_1$ as Va. On the other hand, if the image data "0" (image signal of the low level) is stored in the latch circuit 70 and the transmission gate TG2 is turned on, the switch circuit 80 supplies a signal $S_2$ as Va. With such a circuit configuration, the control section 6 can control the electric potential (signal) supplied to the pixel electrode of each pixel 40. The circuit configuration of the pixel 40 is an example, and thus is not limited to that shown in FIG. 2.

1.1.3. Display Method

The electrophoretic display device 100 according to the present embodiment employs an electrophoretic method of a two-particle system microcapsule type. If a dispersion liquid is colorless and transparent and electrophoretic particles are white or black, at least two colors can be displayed using two colors of black and white as base colors. Here, it is assumed that the electrophoretic display device 100 can display black and white as the base colors. Further, displaying a pixel which displays black with white and displaying a pixel which displays white with black are referred to as inversion.

Figure 3A:
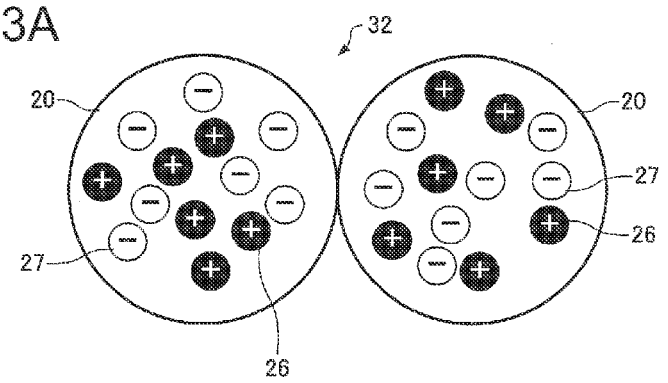
FIG. 3A is a diagram illustrating a configuration example of an electrophoretic element.

FIG. 3A is a diagram illustrating a configuration of an electrophoretic element 32 according to the present embodiment. The electrophoretic element 32 is disposed between a device substrate 30 and an opposing substrate 31 (see FIGS. 3B and 3C). The electrophoretic element 32 has a configuration in which a plurality of microcapsules 20 is arranged. The microcapsule 20 includes, for example, a colorless and transparent dispersion liquid, a plurality of white particles (electrophoretic particles) 27, and a plurality of black particles (electrophoretic particles) 26. In the present embodiment, for example, it is assumed that the white particles 27 are negatively charged and the black particles 26 are positively charged.

Figure 3B:
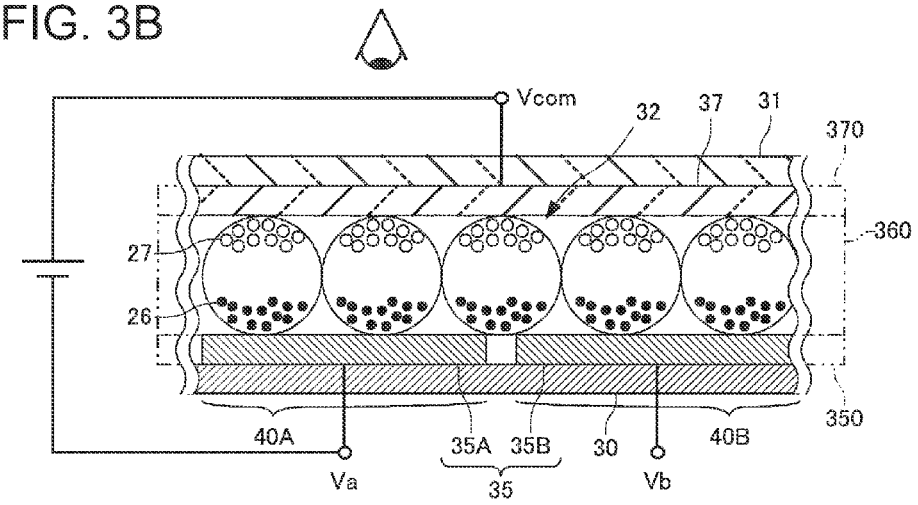
FIGS. 3B and 3C are diagrams illustrating an operation of the electrophoretic element.

FIG. 3B is a partial cross-sectional diagram of the display section 5 of the electrophoretic display device 100. The device substrate 30 and the opposing substrate 31 support therebetween the electrophoretic element 32 in which the microcapsules 20 are arranged. The display section 5 includes a driving electrode layer 350 which includes a plurality of pixel electrodes 35, on a side of the device substrate 30 which faces the electrophoretic element 32. In FIG. 3B, the pixel electrode 35A and the pixel electrode 35B are shown as the pixel electrodes 35. It is possible to supply an electric potential to each pixel by the pixel electrode 35 (for example, Va or Vb). Here, a pixel which has the pixel electrode 35A is referred to as a pixel 40A, and a pixel which has the pixel electrode 35B is referred to as a pixel 40B. The pixel 40A and the pixel 40B are two pixels which correspond to the pixel (see FIGS. 1 and 2).

On the other hand, the opposing substrate 31 is a transparent substrate, and an image is displayed on the side of the opposing substrate 31 in the display section 5. The display section 5 includes a common electrode layer 370 which includes a planar common electrode 37, on a side of the facing substrate 31 which faces the electrophoretic element 32. The common electrode 37 is a transparent electrode. The common electrode 37 is an electrode which is common to all pixels, differently from the pixel electrode 35, and is supplied with an electric potential Vcom.

The electrophoretic element 32 is disposed in an electrophoretic display layer 360 which is disposed between the common electrode layer 370 and the driving electrode layer 350, and the electrophoretic display layer 360 forms a display area. According to an electric potential difference between the common electrode 37 and the pixel electrode (for example, 35A or 35B), it is possible to display a desired color for each pixel.

In FIG. 3B, the electric potential Vcom on the common electrode side is an electric potential which is higher than an electric potential Va of the pixel electrode of the pixel 40A. At this time, since the white particles 27 which are negatively charged are pulled to the side of the common electrode 37, and the black particles 26 which are positively charged are pulled to the side of the pixel electrode 35A, when viewed, the pixel 40A displays white.

Figure 3C:
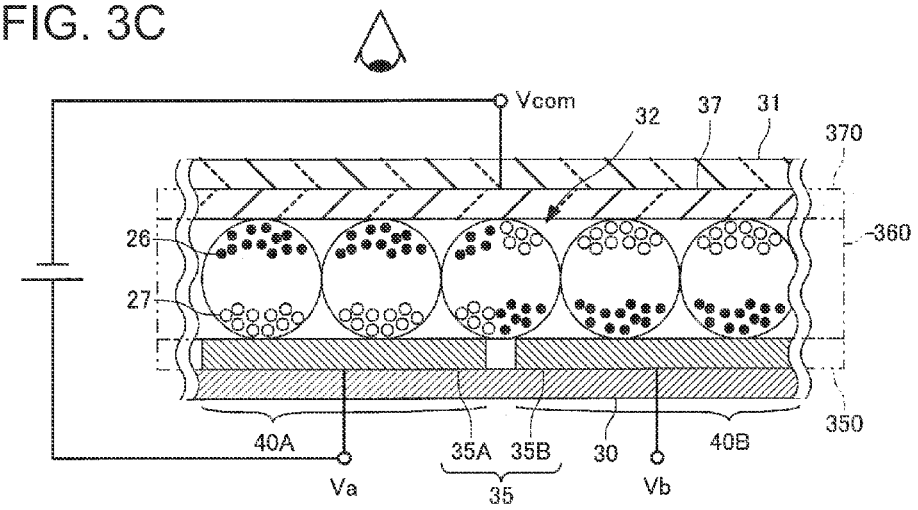

In FIG. 3C, the electric potential Vcom on the common electrode side is an electric potential which is lower than the electric potential Va of the pixel electrode of the pixel 40A. At this time, contrarily, since the black particles 26 which are positively charged are pulled to the side of the common electrode 37, and the white particles 27 which are negatively charged are pulled to the side of the pixel electrode 35A, when viewed, the pixel 40A displays black. Since the configuration of FIG. 3C is the same as that of FIG. 3B, its description will be omitted. Further, in FIGS. 3B and 3C, Va, Vb and Vcom are described as fixed electric potentials, but in reality, Va, Vb and Vcom are pulse signals in which their electric potentials are changed with time.

1.2. Driving Method of Electrophoretic Display Device 1.2.1. Problems in Partial Driving at a Low Temperature Here, a case where partial driving for rewriting in only a part of the display section 5 at a low temperature will be taken into consideration. At this time, it has been experimentally confirmed that even though electric power (driving voltage× driving time) of a pulse signal supplied to the common electrode 37 and the pixel electrode 35 is increased, contrast is lowered at the low temperature, compared with a temperature other than the low temperature. At this time, the reason why the contrast is lowered regardless of the size of the electric power of the pulse signal is that the electric field applied to the electrophoretic particles is weakened and the electrophoretic particles are thus not moved.

Figure 4A:
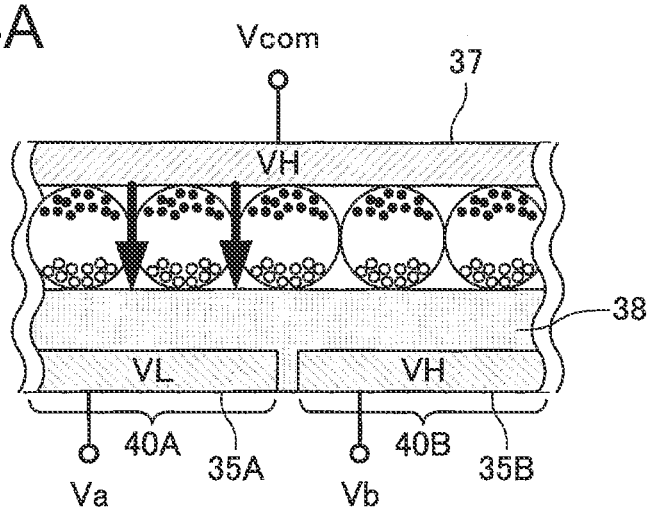
FIGS. 4A and 4B are diagrams illustrating problems at a low temperature.
Figure 4B:
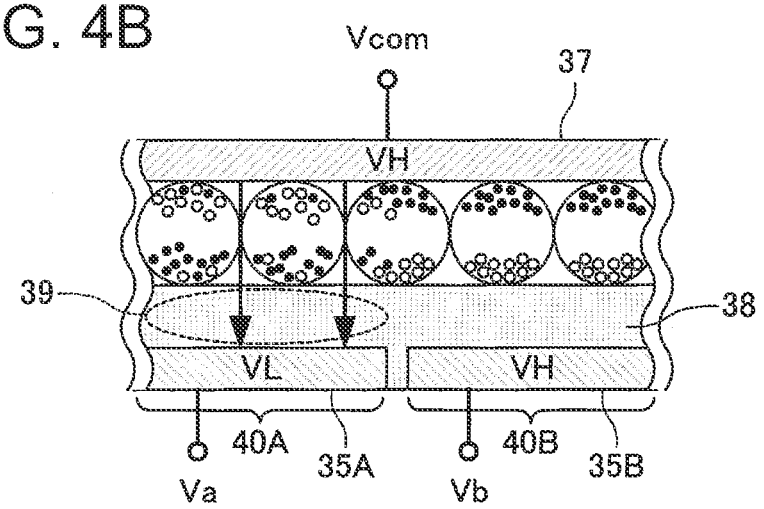

FIGS. 4A and 4B are diagrams illustrating problems in the partial driving at the low temperature. In FIGS. 4A and 4B, an arrow which is directed toward the pixel electrode 35A of the pixel 40A from the common electrode 37 represents an electric field. A circuit configuration of the pixel 40A and the pixel 40B is as shown in FIG. 2, and $S_1$ or $S_2$ are output as Va and Vb, according to image data stored in each latch circuit. The respective signals Va, Vb and Vcom may have a high level (VH), a low level (VL) or a high impedance state (Hi-Z). In FIGS. 4A and 4B, an adhesion layer 38 which is not shown in FIGS. 3A and 3B is included, but the scale size is changed for ease of description. In practice, the adhesion layer 38 is thin, and the pixel electrodes 35A and 35B and the electrophoretic particles are close to each other. A proximity 39 of the pixel electrode represents an area of the adhesion layer 38 in the proximity of the pixel electrode 35A.

The adhesion layer 38 is formed of an adhesive agent of an excellent insulation property, but for example, ions included in the adhesion layer 38 serve as carriers and have a certain level of conductivity. By the existence of such ions, it can be considered that the pixel electrode 35A is disposed to be in contact with the electrophoretic particles.

FIG. 4A illustrates a case where an electric field is applied to display the pixel 40A which displays black with white. Since a voltage based on the same pulse signal as the common electrode 37 is applied to the pixel electrode 35B of the pixel 40B, an electric field is not generated. As shown in FIG. 4A, at a certain time, an electric potential VL of the low level of the pulse signal is applied to the pixel electrode 35A, and an electric potential VH of the high level is applied to the common electrode 37 and the pixel electrode 35B. Since the white particles which are negatively charged are pulled to the side of the common electrode 37 in the pixel 40A, the display color of the pixel 40A is changed from black to white.

FIG. 4B illustrates a state where the reflectance is saturated without the electrophoretic particles being moved any more with time. At this time, a voltage applied to the common electrode 37 and the pixel electrodes 35A and 35B is the same as that of FIG. 4A, but the electric field is weakened as indicated by the arrow. This is because it is inferred that as the ions included in the adhesion layer 38 are removed from the proximity 39 of the pixel electrode of the pixel 40A, it cannot be considered that the pixel electrode 35A is disposed to be in contact with the electrophoretic particles. It is inferred that as the electric field is weakened, the electrophoretic particles do not move, which influences the arrival reflectance to lower the contrast.

In addition to the influence of the adhesive agent used in the adhesion layer 38, it is considered that in a case where the electric field is applied in a certain direction, the ions are likely to act repulsively. Further, if the partial driving is performed, a state where the electric field is not applied to the adjacent pixel may occur (pixel 40B in FIGS. 4A and 4B). Thus, in the partial driving, it is considered that the repulsively acting ions easily escape and the electric field is weakened to lower the contrast. At this time, since the repulsive action of the ions occurs with respect to the electric field in the certain direction, the partial driving by reverse electric potential (which will be described later) is easily influenced. On the other hand, in the full driving, since a state where the electric field is not applied to the adjacent pixel does not continue for a long time, this phenomenon hardly occurs.

Here, since the viscosity of the dispersion liquid increases, for example, at the low temperature, the weakening of the electric field significantly influences the movement amount of the electrophoretic particles. Thus, particularly, in the partial driving at the low temperature, the lowering of the contrast causes a problem. According to some experiments, the low temperature is, for example, 10° C. or lower.

1.2.2. Reverse Electric Potential Driving Pulse

In the electrophoretic display device, the partial driving (hereinafter, referred to as "reverse electric potential driving") which uses a pulse signal including a reverse electric potential driving pulse may be performed in order to increase the response speed.

Figure 5A:
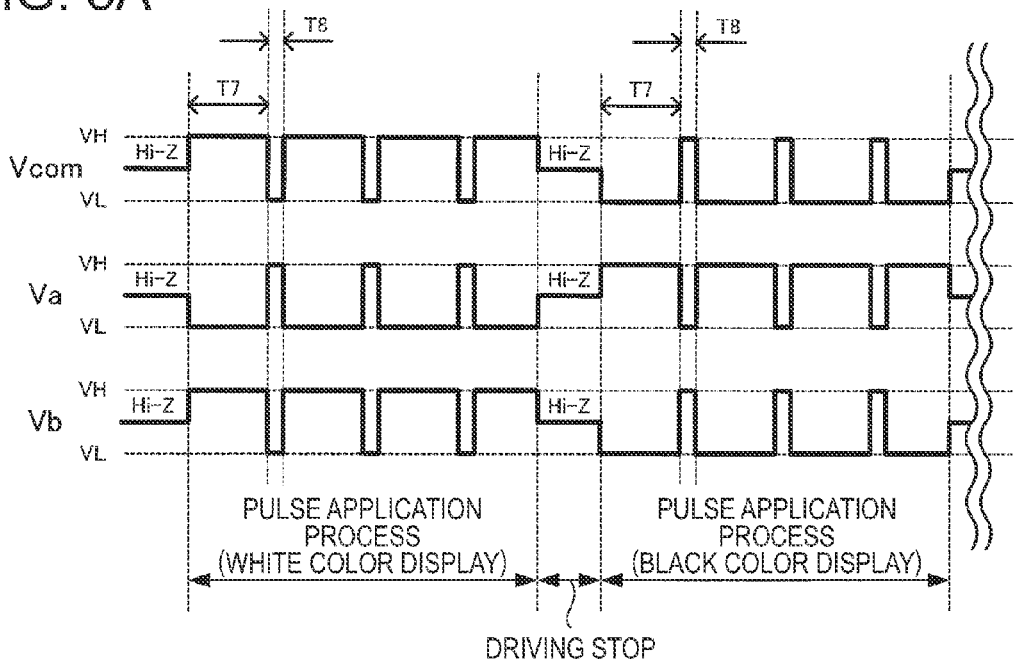
FIGS. 5A and 5B are diagrams illustrating reverse electric potential driving.

FIG. 5A illustrates an example of a reverse electric potential driving pulse included in the pulse signal Vcom supplied to the common electrode. The same reference numerals are given to the same elements as in FIG. 3A to FIG. 4C, and detailed descriptions thereof will be omitted. In Vcom, subsequent to a pulse of applying the first electric potential to the common electrode with a certain pulse width T7, a pulse (reverse electric potential driving pulse) of applying the second electric potential to the common electrode with a short pulse width T8 is continued, which is repeated. Here, at the final stage of the pulse application process of white color display or black color display, the first electric potential is exceptionally applied to the common electrode for termination. Using the reverse electric potential driving pulse having the short pulse width, it is possible to reduce the driving time at the partial rewriting time. Here, in the case of the white color display, the first electric potential is VH, and in the case of the black color display, the first electric potential is VL. Further, for example, T8 may be a short time of about 1% to 15% of T7.

In this example, Va supplied to the pixel electrode of the pixel 40A is a reverse signal of Vcom, and Vb supplied to the pixel electrode of the pixel 40B is the same signal as Vcom. The pixel 40A is rewritten from black to white in the pulse application process (white color display), and is rewritten from white to black in the pulse application process (black color display). On the other hand, in the pixel 40B, since the electric field is not generated between the common electrode and the pixel electrode, rewriting is not performed, and the black color display is continued.

Figure 5B:
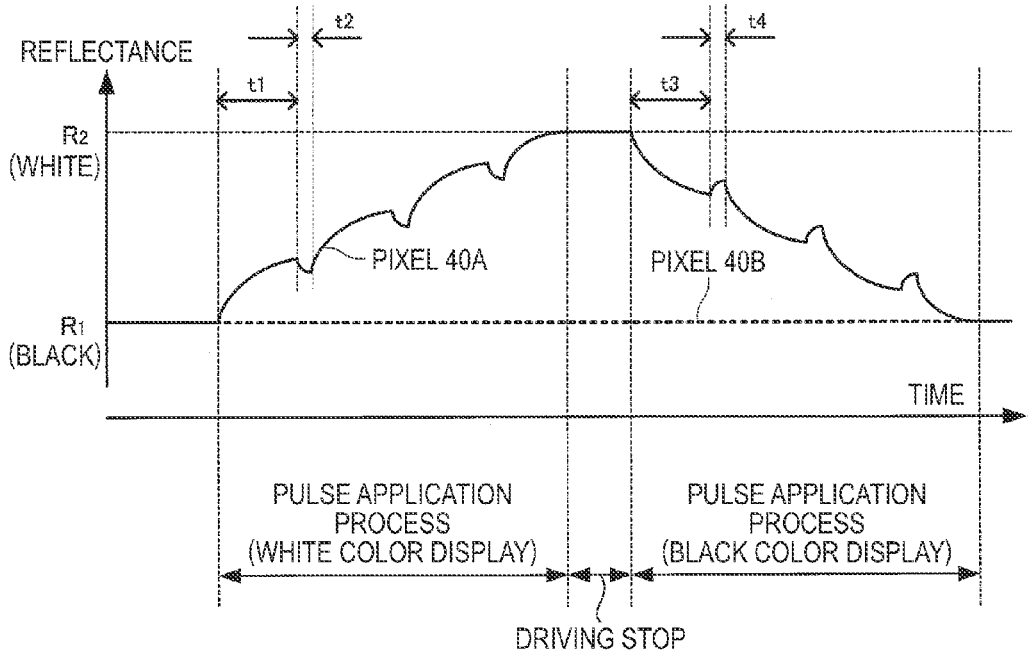

FIG. 5B is a diagram illustrating color change of the pixel 40A and the pixel 40B according to the example of FIG. 5A. Firstly, the pixel 40A will be described. It is assumed that the pixel 40A displays black before a section t1. In the section t1 (corresponding to T7 in FIG. 5A), since the electric potential of the pixel electrode is VL, and the electric potential of the common electrode is VH, the white color display is approximately performed. However, in a subsequent section t2 (corresponding to T8 in FIG. 5A), since the electric potential of the pixel electrode is VH, and the electric potential of the common electrode is VL, the black color display is approximately performed. However, since T7>T8, the pixel 40A displays white at the final stage of the pulse application process (white color display). Further, the pixel 40A displays black at the final stage of the pulse application process (black color display) in which the polarity of Vcom is reversed. A section t3 corresponds to the section t1, and a section t4 corresponds to the section t2.

On the other hand, the pixel 40B continuously maintains the black color display before the section t1 without causing the electric potential difference since the same signal as the Vcom is constantly supplied to the pixel electrode. In this way, it is possible to reduce the driving time at the partial rewriting time by using the reverse electric potential driving pulse having the short width.

However, as shown in FIG. 5A, in the case of the white color display and in the case of the black color display, an electric field which is biased in a specific direction is applied between the electrodes of the pixel 40A. This means that the contrast is caused to be easily lowered at the low temperature in the reverse electric potential driving.

Thus, the driving method of the electrophoretic display device according to the present embodiment which solves the above-mentioned problem will be described with reference to FIGS. 6A and 6B. Hereinafter, the reverse electric potential driving is performed, but even in partial driving (in the case of T7=T8 in FIG. 5A) other than the reverse electric potential driving, the same driving method can be used.

1.2.3. Flowchart

Figure 6A:
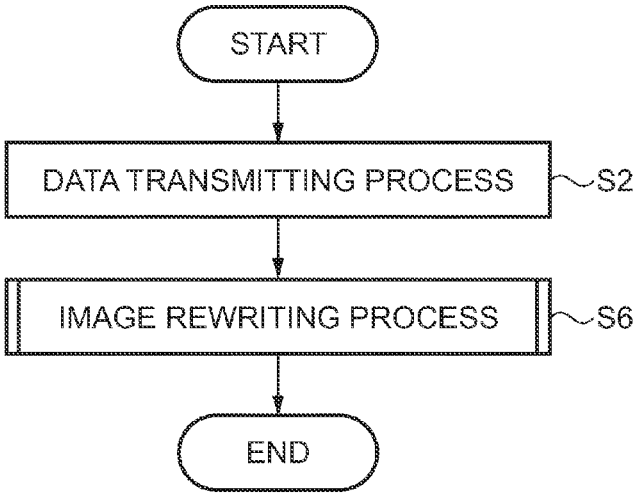
FIGS. 6A and 6B are flowcharts of a driving method according to the first embodiment.

FIG. 6A is a flowchart of a main routine illustrating the driving method of the electrophoretic display device according to the first embodiment.

When the controller 63 (see FIG. 1) rewrites an image to be displayed on the display section 5, firstly, the controller 63 performs a data transmitting process of obtaining an image signal from the storing section 160 and controlling the scanning line driving circuit 61 and the data line driving circuit 62 to transmit the data to each pixel (S2).

Next, the controller 63 performs an image rewriting process of rewriting the image to be displayed on the display section 5 on the basis of the image signal by the common power modulation circuit 64 (S6). In the image rewriting process, in order to perform a high contrast display at the low temperature, the following sub routine flowchart is given.

Figure 6B:
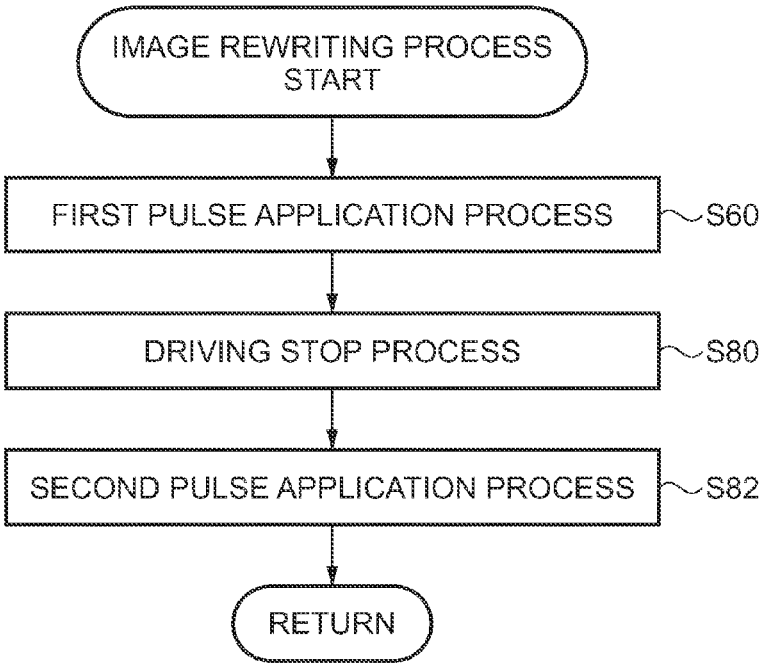

FIG. 6B is a flowchart of a sub routine of the image rewriting process S6 in the first embodiment. In the present embodiment, the image rewriting process step S6 includes a first pulse application process S60, a driving stop process S80, and a second pulse application process S82. Here, the pulse signal supplied to the common electrode is referred to as a "driving pulse signal". In the reverse electric potential driving, a signal obtained by reversing the driving pulse signal is supplied to a pixel electrode of a pixel in which rewriting is performed among the plurality of pixel electrodes, and the same signal as the driving pulse signal is supplied to a pixel electrode of a pixel in which rewriting is not performed.

In the first pulse application process S60, a voltage based on the first pulse signal in which the pulse width of the first electric potential is a first width is applied as the driving pulse signal. The first electric potential is the high level (VH) in the case of the white display, and is the low level (VL) in the case of the black display. In the first pulse application process S60, since the electric field which is biased in a specific direction is applied to the electrophoretic element, the phenomenon occurs that the electric field is weakened, which is considered to be caused by outflow of the ions of the adhesion layer 38. Thus, even though the first pulse application process S60 is terminated at the low temperature, the obtained contrast is low.

Thus, in the present embodiment, the driving stop process S80 which stops the driving of the pulse signal with respect to the electrode is performed subsequent to the first pulse application process S60. During the driving stop process S80, since the same fixed electric potential is applied to the common electrode and the pixel electrode, the electric field is not generated. Then, it is considered that the ions which act repulsively against the electric field in a specific direction and move from the proximity of the pixel electrode to a different area are diffused by removal of the electric field, and then are again present in the proximity of the pixel electrode. Thus, after the driving stop process S80, the electric field is not weakened. In the driving stop process S80, the common electrode and the pixel electrode are in the high impedance state, and thus, the electric field does not have to be generated.

In the second pulse application process S82, a voltage based on the second pulse signal in which the pulse width of the first electric potential is a second width is applied as the driving pulse signal. The second width is longer than the first width of the first pulse signal, and the time when the electric field acts on the electrophoretic particles is long. Thus, it is possible to increase the arrival reflectance indicating white or to decrease the arrival reflectance indicating black, and to improve the contrast. In the second pulse application process S82, the reflectance becomes close to a desired reflectance to some extent due to the first pulse application process S60, and even though the voltage based on the pulse signal of the long pulse width is applied, flickering does not occur.

1.2.4. Example of waveform diagram and color change

Figure 7A:
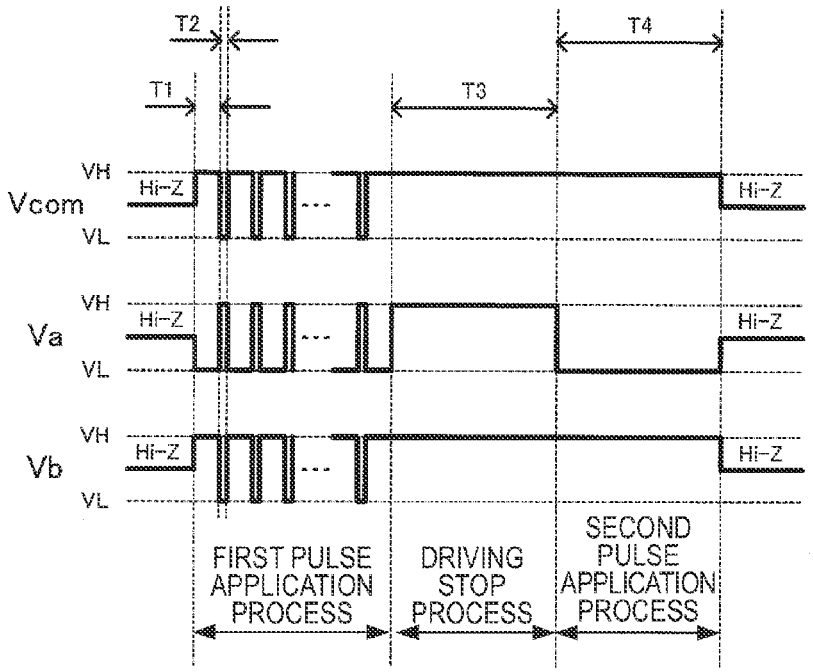
FIGS. 7A and 7B are diagrams illustrating the driving method according to the first embodiment.
Figure 7B:
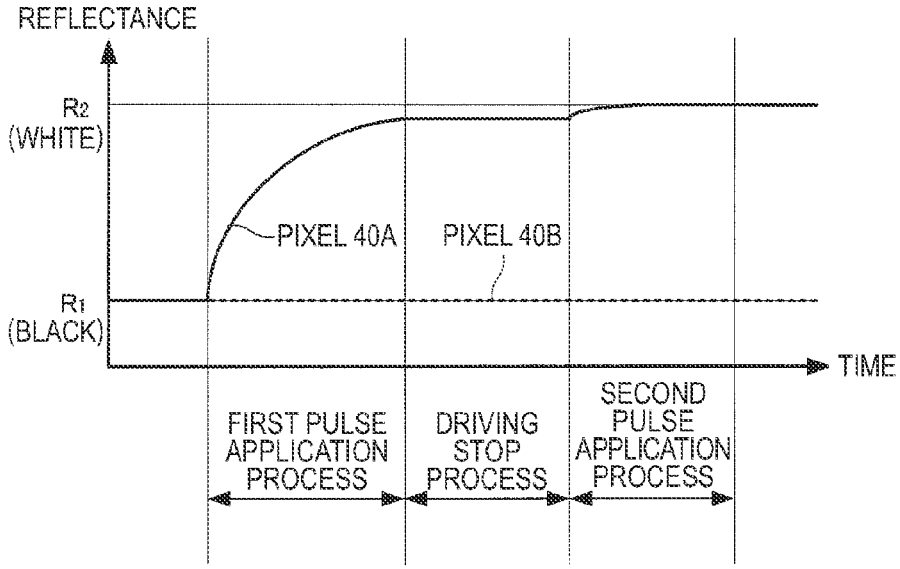

FIGS. 7A and 7B illustrate waveform diagrams and the like when the reverse electric potential driving is performed by the driving method according to the first embodiment. In the figure, since Va, Vb, Vcom, VH and VL are the same as those of FIG. 3A to FIG. 4C, detailed descriptions thereof will be omitted.

FIG. 7A is a waveform diagram illustrating a case where the pixel 40A is changed from black to white and the pixel 40B displays black as it is, by the driving method of the electrophoretic display device according to the first embodiment.

In the first pulse application process, Va is a signal obtained by reversing Vcom, and Vb is the same signal as Vcom. Here, in the case of the white color display, the first electric potential is VH. By shortening the pulse width T2 of the second electric potential, compared with the pulse width (first width) T1 of the first electric potential, it is possible to reduce the driving time of the first pulse application process.

At the low temperature (for example, 10° C. or lower), the first pulse application process uses the first pulse signal in which a pulse having T1 of 500 ms and T2 of 10 ms, for example, is repeated ten times.

In the driving stop process, Vcom, Va and Vb are all a fixed electric potential VH, and the electric field is not generated. In the period T3 of the driving stop process, since the ions separated from the area around the pixel electrode of the pixel 40A return by diffusion, the cause of weakening the electric field is removed, and thus, the electrophoretic particles are easily moved. For example, the period T3 is 500 ms, and it can be experimentally understood that a preferable result is obtained when T3 is 500 ms or longer.

In the second pulse application process, in a similar way to the first pulse application process, Va is a signal obtained by reversing Vcom, and Vb is the same signal as Vcom. In order to move the electrophoretic particles until a sufficient reflectance is obtained, T4 (second width) is set to a value which is equal to or larger than T1 (first width). For example, T4 is 1,500 ms, and it can be experimentally understood that a preferable result is obtained when T4 is set to 500 ms to 1,500 ms. In the second pulse application process of FIG. 7A, the pulse signal includes only one pulse, but the pulse signal in which the pulse is repeated may be used.

FIG. 7B is a diagram illustrating color change of the pixel 40A and the pixel 40B according to the example in FIG. 7A. Firstly, in the first pulse application process, the reflectance of the pixel 40A is changed to about 85% of the arrival reflectance $R_2$ indicating white, but since the ions of the adhesion layer act repulsively against the electric field to flow out, it is difficult to further increase the reflectance. Thus, the second pulse application process is performed after the ions are diffused by the driving stop process to achieve the same distribution. Further, in the second pulse application process, it is possible to obtain the arrival reflectance $R_2$ by the second pulse signal having the long pulse width. The electric field is not generated in the pixel 40B and the electrophoretic particles are not moved. Accordingly, the pixel 40B displays black as it is.

2. Second Embodiment

A second embodiment of the invention will be described with reference to FIG. 8 to FIG. 10B. In the figures, the same reference numerals are given to the same elements as in FIG. 1 to FIG. 7B, and detailed descriptions thereof will be omitted.

2.1. Temperature Determination Circuit

The electrophoretic display device 100 according to the second embodiment includes a temperature determination circuit in addition to the configuration of the electrophoretic display device 100 in the first embodiment. The electrophoretic display device 100 according to the second embodiment measures an environmental temperature by the temperature determination circuit and performs a driving stop control and a second pulse application control only at the low temperature. In the case of the temperature other than the low temperature, the driving time is reduced to quicken the response at the time of image rewriting with such a control. Further, it is possible to perform a high contrast display regardless of the environmental temperature. Here, the temperature determination circuit may be apart of the control section, for example.

Figure 8:
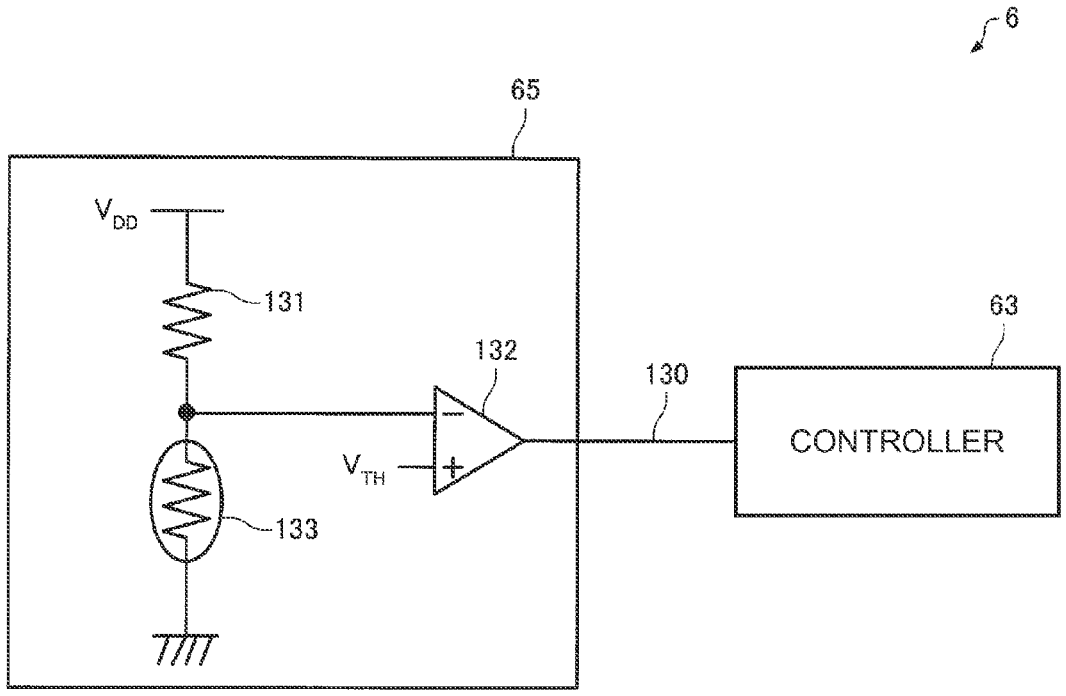
FIG. 8 is a diagram illustrating an example of a temperature determination circuit according to a second embodiment.

FIG. 8 illustrates a specific example of the temperature determination circuit 65 included in the control section 6 according to the present embodiment. The other configuration is the same as in the first embodiment (see FIG. 1), and its illustration and description will be omitted. The temperature determination circuit 65 uses a resistor connected to a ground electric potential among divided resistors as a thermistor 133. The thermistor 133 is an NTC (Negative Temperature Coefficient) thermistor, for example, and its resistance value becomes small according to a temperature increase. Another resistor 131 connected to the side of a high electric potential (for example, $V_{DD}$) has a fixed resistance value.

The temperature determination circuit 65 compares a threshold electric potential $V_{TH}$ corresponding to a threshold temperature with an electric potential which is resistance-divided by a comparator 132, and then outputs a temperature determining signal 130 to the controller 63. In a case where the environmental temperature is lower than the threshold temperature, the contrast is lowered due to the low temperature. For example, in a case where the environmental temperature is reduced to be lower than the threshold temperature, the resistance-divided electric potential which is input to a non-reverse input terminal of the comparator 132 becomes higher than the threshold electric potential $V_{TH}$. At this time, the temperature determination circuit 65 outputs the temperature determining signal 130 of a low level. The controller 63 of the electrophoretic display device 100 according to the second embodiment changes the driving method according to whether the temperature determining signal 130 is the low level (low temperature) or the high level (temperature other than the low temperature) as described later.

2.2. Flowchart

Figure 9:
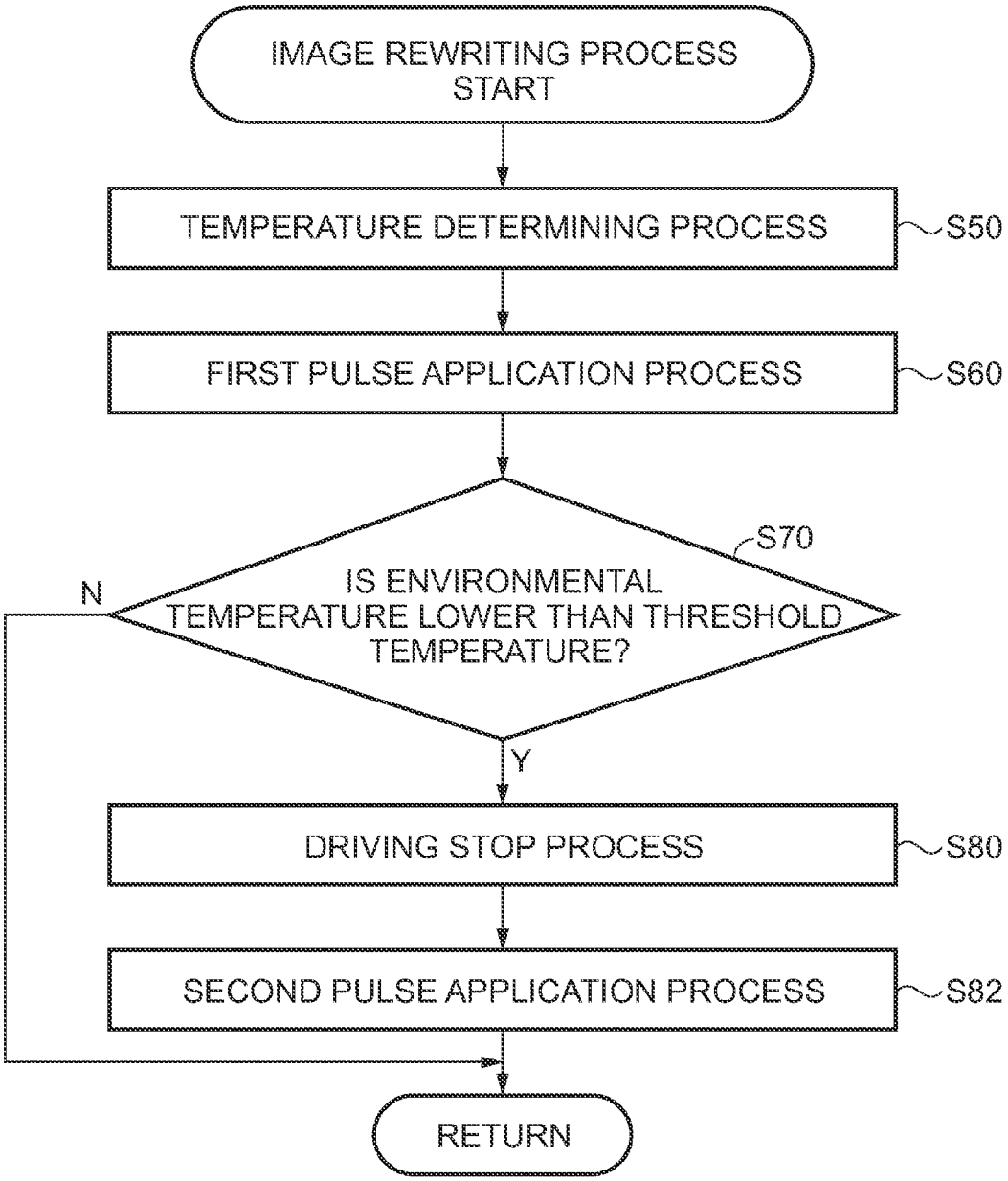
FIG. 9 is a flowchart of a driving method according to the second embodiment.

FIG. 9 is a flowchart of a sub routine of the image rewriting process S6 in the second embodiment. A main routine indicating the driving method of the electrophoretic display device in the second embodiment is the same as in the first embodiment (see FIG. 6A), and its description will not be described. Further, the same reference numerals are given to the same processes as in FIG. 6B, and descriptions thereof will be omitted.

In the present embodiment, the image rewriting process S6 includes a temperature determining process S50 and the first pulse application process S60, and the driving stop process S80 and the second pulse application process S82 are performed only when the environmental temperature is lower than the threshold temperature (low temperature).

The temperature determining process S50 is a process in which the controller 63 determines whether the environmental temperature is the low temperature or not on the basis of the temperature determining signal 130.

The first pulse application process S60 is performed regardless of whether the environmental temperature is the low temperature or not. Thereafter, if it is determined in the temperature determining process S50 that the environmental temperature is the low temperature (S70: Y), the driving stop process S80 and the second pulse application process S82 are performed. At this time, it is possible to perform a high contrast display even at the low temperature.

If it is determined in the temperature determining process S50 that the environmental temperature is the temperature other than the low temperature, the driving stop process S80 and the second pulse application process S82 are not performed (S70: N). In the case of the temperature other than the low temperature, since the contrast is not lowered, it is not necessary to perform the driving stop process S80. Further, since a sufficient contrast is obtained only in the first pulse application process S60, it is not necessary to perform the second pulse application process S82. In this way, since the image rewriting process in the second embodiment includes the temperature determining process S50, the unnecessary processes are omitted at the temperature other than the low temperature. Thus, the driving time is reduced to thereby quicken the response at the image rewriting time.

The first pulse application process S60 may change the driving time at the low temperature and at the temperature other than the low temperature. For example, in a case where the reflectance reaches the arrival reflectance in the middle of the first pulse application process S60 in the case of the temperature other than the low temperature, the driving time may be reduced. Thus, it is possible to further quicken the response at the image rewriting time. Further, in the present embodiment, in the case of the temperature other than the low temperature, the driving stop process S80 and the second pulse application process S82 are omitted, but only the driving stop process S80 may be omitted. At this time, it is possible to reliably perform a high contrast image display regardless of the environmental temperature.

2.3. Example of Waveform Diagrams

Figure 10A:
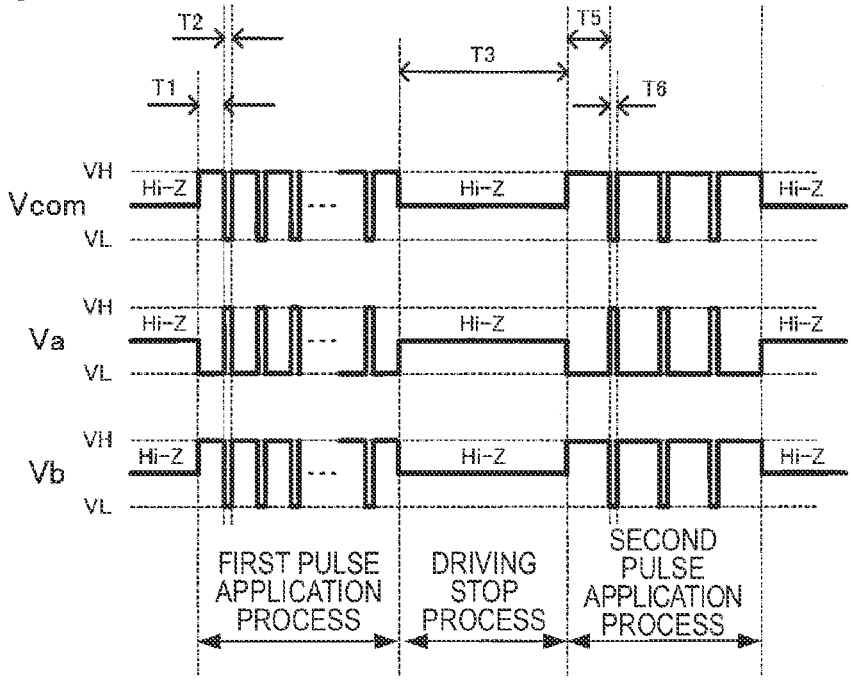
FIGS. 10A and 10B are waveform diagrams according to the second embodiment.
Figure 10B:
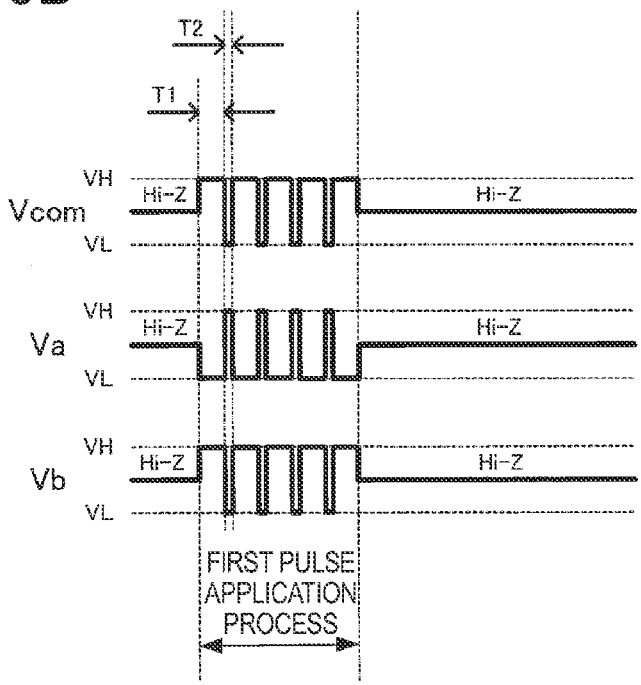

FIGS. 10A and 10B illustrate waveform diagrams of pulse signals when the reverse electric potential driving is performed by the driving method according to the second embodiment. The same reference numerals are given to the same elements as in FIG. 7A, and descriptions thereof will be omitted.

FIG. 10A illustrates waveform diagrams of pulse signals at the low temperature according to the second embodiment. The first pulse application process is the same as in the first embodiment (FIG. 7A), and its description will be omitted. In the driving stop process, the common electrode and the pixel electrode are all in the high impedance state, and thus, an electric field is not generated between the common electrode and the pixel electrode. At this time, it is possible to suppress power consumption, compared with the case of the first embodiment in which the common electrode and the pixel electrode are fixed at a common electric potential. In the second pulse application process, differently from the first embodiment, a pulse signal including a pulse which is repeated a plurality of times is used. At this time, it is preferable that the pulse width T5 (second width) be longer than the pulse width T6 of the reverse electric potential pulse and be equal to or longer than T1 (first width).

FIG. 10B illustrates waveform diagrams of pulse signals in the case of the temperature other than the low temperature according to the second embodiment. At this time, only the first pulse application process is performed. The pulse signal of the first pulse application process has the pulse widths T1 and T2 which are the same as in the case of the low temperature (FIG. 10A), but the driving time is shortened. At the low temperature, for example, the driving time may be lengthened since the viscosity of the dispersion liquid is increased. However, in the case of the temperature other than the low temperature, it is possible to reach the arrival reflectance with a shorter driving time. In the present embodiment, only the first pulse application process is performed, and the driving time is adjusted, to thereby quicken the response at the image rewriting time.

3. Application Example

An application example of the invention will be described with reference to FIGS. 11A and 11B. The electrophoretic display device 100 may be applied to a variety of electronic apparatuses.

Figure 11A:
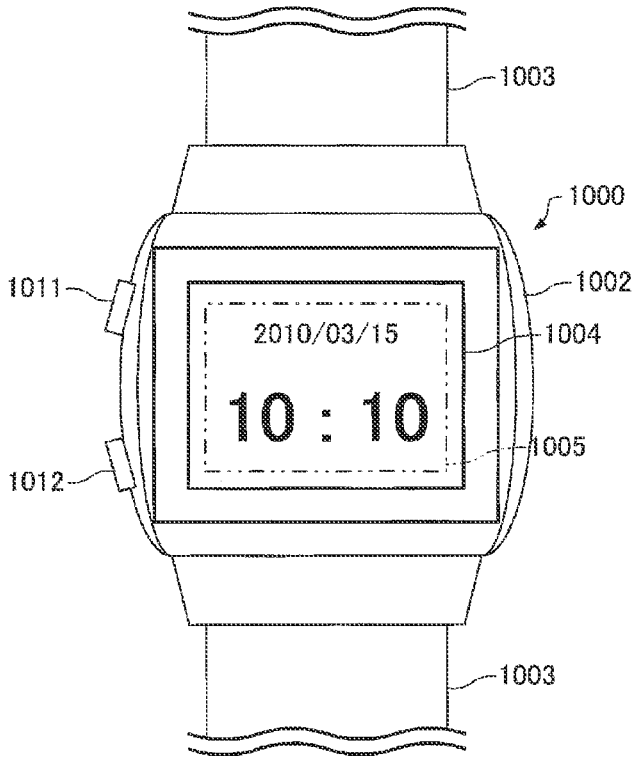
FIGS. 11A and 11B are diagrams illustrating an electronic apparatus according to an application example.

For example, FIG. 11A is a front view of a wrist watch 1000 which is a kind of electronic apparatus. The wrist watch 1000 includes a watch case 1002 and a pair of bands 1003 connected to the watch case 1002. At a front portion of the watch case 1002, a display portion 1004 which includes the electrophoretic display device 100 is disposed, and the display section 1004 performs a display 1005 which includes a time display. At a side portion of the watch case 1002, two operation buttons 1011 and 1012 are disposed. A variety of display types such as time, calendar, alarm or the like may be selected as the display 1005 by the operation buttons 1011 and 1012.

Figure 11B:
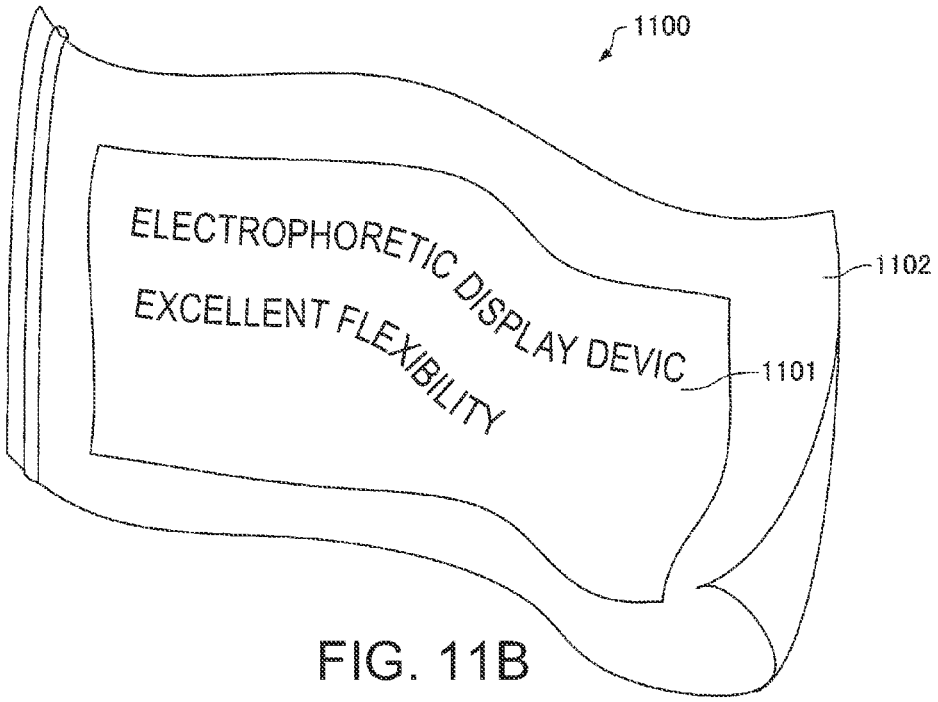

Further, FIG. 11B is a perspective view of an electronic paper 1100 which is a kind of electronic apparatus, for example. The electronic paper 1100 has flexibility, and includes a display area 1101 which includes the electrophoretic display device 100 and a main body 1102.

The electronic apparatus which includes the electrophoretic display 100 can display a high quality image with high contrast even at the low temperature.

4. Others

In the above-described embodiments, the electrophoretic display device is not limited to an electrophoretic display device of a two-particle system of black and white which uses black and white particles, but may be an electrophoretic display device of a single particle system of blue, white or the like, or may be an electrophoretic display device having a color combination other than the black and white combination. Further, the driving method is not limited to the active matrix type, and may be a segment type.

Further, the invention is not limited to the electrophoretic display device, and the driving method may be applied to a display device with a memory ability. For example, the driving method may be applied to an ECD (electrochromic display), a ferroelectric liquid crystal display, a cholesteric liquid crystal display or the like.

The invention is not limited to the exemplary embodiments, and includes substantially the same configuration (for example, configuration having the same functions, methods and results or configuration having the same objects and effects) as the configuration described in the embodiments. Further, the invention includes a configuration in which sections which are not essential in the configuration described in the embodiments are replaced. Further, the invention includes a configuration having the same effects as the configuration described in the embodiments or a configuration capable of achieving the same objects. Further, the invention includes a configuration in which any known technology is added to the configuration described in the embodiments.

What is claimed is:

1. A driving method of an electrophoretic display device, comprising:

providing said electrophoretic display with a display section in which an electrophoretic element including electrophoretic particles is disposed between a pair of substrates, said display section including an arrangement of a plurality of pixels, wherein pixel electrodes address the pixels, said pixel electrodes being formed between one of the substrates and the electrophoretic element, and wherein a common electrode that is coupled to all the pixels and that faces the plurality of pixel electrodes is formed between the other one of the substrates and the electrophoretic element, wherein Va is a first driving pulse signal applied to a first pixel electrode of a first pixel, Vb is a second driving pulse signal applied to a second pixel electrode of a second pixel, and Vcom is a third driving pulse signal applied to the common electrode;

rewriting a desired color to the first pixel by applying a three-phase color-changing drive sequence to Va, Vb and Vcom to move the electrophoretic particles of the first pixel by an induced electric field between the common electrode and the first pixel electrode, wherein the three-phase color-changing drive sequence includes:

a first phase including a first pulse application process wherein Vcom and Vb have a first logic pulse signal and Va has a second logic pulse signal, said second logic pulse signal being the logic opposite of said first logic pulse signal;

a second phase following the first phase, said second phase including a driving stop process wherein Vcom, Va and Vb all have a third logic pulse signal set at a predetermined level to stop the induced electric field between the common electrode and the first pixel electrode; and a third phase following the second phase, said third phase including a second pulse process wherein Vcom and Vb have a fourth logic pulse signal and Va has a fifth logic pulse signal, said fifth logic pulse signal being the logic opposite of said fourth pulse signal.

2. The method according to claim 1, wherein the rewriting includes a temperature determination determining whether an environmental temperature is a predetermined threshold temperature or higher, and wherein in a case where it is determined in the temperature determination that the environmental temperature is the predetermined threshold temperature or higher, the three-phase color-changing drive sequence is replaced with a one-phase color-changing drive sequence consisting of only the first pulse application process.

3. The method according to claim 2, wherein in a case where it is determined in the temperature determination that the environmental temperature is the predetermined threshold temperature or higher, a driving time of the first pulse application process is shortened in the rewriting as compared to when the environmental temperature is not the predetermined threshold temperature or higher.

4. The method according to claim 1, wherein in the driving stop process said third logic pulse signal is applied to all of said plurality of pixels electrodes.

5. The method according to claim 1, wherein:

application of the three-phase color-changing drive sequence to Va, Vb and Vcom to rewrite the desired color to the first pixel includes creating an induced movement of the electrophoretic particles of the first pixel from an initial position to a target position by the induced electric field between the common electrode and the first pixel electrode;

in the first phase of the three-phase color-changing drive sequence, the second logic pulse signal that is the logic opposite of the first logic pulse signal actuates the induced electric field that creates the induced movement of the electropheric particles towards the target position;

in the second phase of the three-phase color-changing drive sequence, the third logic pulse signal that stops the induced electric field between the common electrode and the first pixel electrode, also halts the induced movement of the electropheric particles at an intermediate position between the initial position and the target; and in the third phase of the three-phase color-changing drive sequence, the second pulse process re-actuates the induced electric field that creates the induced movement of the electropheric particles towards their target position.

6. The driving method of claim 1, wherein said third logic pulse signal maintains a first constant logic level during the entirety of said driving stop process.

7. The driving method of claim 6, wherein said first constant logic level is a logic high level.

8. The driving method of claim 6, wherein said fourth logic pulse signal maintains a second constant logic level during the entirety of said second pulse process.

9. The driving method of claim 8, wherein said second constant logic level is the same as the first constant logic level.

10. The driving method of claim 1, wherein said first logic pulse signal is a sequence of consecutive pulse cycles, each pulse cycle being comprised of a starting pulse width, T1, at a starting logic level followed an ending pulse width, T2, at an ending logic level opposite the starting logic level, wherein T2 is not greater than half T1.

11. The driving method of claim 10, wherein T2 is not greater than 20% of T1.

12. The driving method of claim 10, wherein:

said third logic pulse signal maintains a first constant logic level during the entirety of said driving stop process, and the duration, T3, of the entirety of said driving stop process is not greater than T1.

13. The driving method of claim 12, wherein:

said fourth logic pulse signal maintains a second constant logic level during the entirety of said second pulse process, and the duration, T4, of the entirety of said second pulse process is not greater than three times T1.

14. The driving method of claim 12, wherein:

said fourth logic pulse signal maintains a second constant logic level during the entirety of said second pulse process, and the duration, T4, of the entirety of said second pulse process is not less than T1 and not greater than three times T1.

15. The method according to claim 1, wherein said rewriting of a desired color to the first pixel is part of an image-write operation to move microcapsules of the pixel from an initial known position to a target position to write a new image onto said electrophoretic display, said desired color being determined by the target position of the microcapsules, and said three-phase color-changing drive sequence being applied during the moving of the microcapsules from their initial known position to their target position.

16. An electrophoretic display device comprising:

a display section in which an electrophoretic element including electrophoretic particles is disposed between a pair of substrates, said display section including an arrangement of a plurality of pixels; and a control section that controls the display section;

wherein the display section includes:

pixel electrodes that address the pixels, said pixel electrodes being formed between one of the substrates and the electrophoretic element;

a common electrode coupled to all the pixels is formed between the other one of the substrates and the electrophoretic element to face the plurality of pixel electrodes;

Va is a first driving pulse signal applied to a first pixel electrode of a first pixel, Vb is a second driving pulse signal applied to a second pixel electrode of a second pixel, and Vcom is a third driving pulse signal applied to the common electrode;

wherein the control section rewrites a desired color to the first pixel by applying a three-phase color-changing drive sequence to Va, Vb and Vcom to move the electrophoretic particles of the first pixel by an induced electric field between the common electrode and the first pixel electrode, and wherein three-phase color-changing drive sequence rewriting includes:

a first phase including a first pulse application process wherein Vcom and Vb have a first logic pulse signal and Va has a second logic pulse signal, said second logic pulse signal being the logic opposite of said first logic pulse signal;

a second phase following the first phase, said second phase including a driving stop process wherein Vcom, Va and Vb all have a third logic pulse signal set at a predetermined level to stop the induced electric field between the common electrode and the first pixel electrode; and a third phase following the second phase, said third phase including a second pulse application process wherein Vcom and Vb have a fourth logic pulse signal and Va has a fifth logic pulse signal, said fifth logic pulse signal being the logic opposite of said fourth pulse signal.

17. The electrophoretic display device according to claim 16, wherein the control section includes a temperature determination circuit that determines whether an environmental temperature is a predetermined threshold temperature or higher, and wherein in a case where it is determined by the temperature determination circuit that the environmental temperature is the predetermined threshold temperature or higher, the three-phase color-changing drive sequence is replaced with a one-phase color-changing drive sequence consisting of only the first pulse application process.

18. An electronic apparatus comprising the electrophoretic display device according to claim 16.

19. The electrophoretic display device of claim 16, wherein:

said third logic pulse signal maintains a first constant logic level during the entirety of said driving stop process;

said fourth logic pulse signal maintains a second constant logic level during the entirety of said second pulse process; and said second constant logic level is the same as the first constant logic level.

20. The electrophoretic display device of claim 16, wherein:

said first logic pulse signal is a sequence of consecutive pulse cycles, each pulse cycle being comprised of a starting pulse width, T1, at a starting logic level followed by an ending pulse width, T2, at an ending logic level opposite the starting logic level, wherein T2 is not greater than half T1, said third logic pulse signal maintains a first constant logic level during the entirety of said driving stop process, and the duration, T3, of the entirety of said driving stop process is not greater than T1, said fourth logic pulse signal maintains a second constant logic level during the entirety of said second pulse process, and the duration, T4, of the entirety of said second pulse process is not less than T1 and not greater than three times T1.

* * * * *